US007946314B1

(12) United States Patent
Perone

(10) Patent No.: US 7,946,314 B1
(45) Date of Patent: May 24, 2011

(54) POWER PLIERS FOR TWISTING WIRES

(76) Inventor: John Perone, Seaville, NJ (US)

( * ) Notice: Subject to any disclaimer, the term of this patent is extended or adjusted under 35 U.S.C. 154(b) by 623 days.

(21) Appl. No.: 11/981,130

(22) Filed: Oct. 31, 2007

(51) Int. Cl.
*B21F 7/00* (2006.01)

(52) U.S. Cl. ..... 140/119; 140/149

(58) Field of Classification Search ..... 140/117–119, 140/121–123, 149; 7/125, 107, 130; 30/228
See application file for complete search history.

(56) References Cited

U.S. PATENT DOCUMENTS

| | | | | | |
|---|---|---|---|---|---|
| 2,181,746 | A | * | 11/1939 | Siebrandt | 7/125 |
| 2,394,807 | A | * | 2/1946 | Robinson | 140/119 |
| 2,990,613 | A | | 7/1961 | Keane et al. | |
| 3,056,967 | A | | 10/1962 | Murray | |
| 3,470,772 | A | * | 10/1969 | Faust, Sr. | 76/37 |
| 3,888,003 | A | | 6/1975 | Brown | |
| 4,388,953 | A | | 6/1983 | Hara et al. | |
| 5,033,195 | A | | 7/1991 | Appelkvist et al. | |
| 5,758,729 | A | | 6/1998 | Undin | |
| 5,887,631 | A | | 3/1999 | Eaton | |
| 6,139,228 | A | * | 10/2000 | Longo | 408/240 |

FOREIGN PATENT DOCUMENTS

| | | |
|---|---|---|
| GB | 2 211 448 | 7/1989 |

* cited by examiner

*Primary Examiner* — Teresa M Ekiert
(74) *Attorney, Agent, or Firm* — Norman E. Lehrer

(57) ABSTRACT

Power driven pliers are capable of twisting the ends of a plurality of electrical wires together to make an electrical and mechanical connection therebetween. The pliers include first and second jaws and first and second handles. The jaws and handles are pivotally connected to each other at a pivot point such that movement of said handles toward each other moves said jaws toward each other. A rotatable chuck is carried by one of the jaws and has a central opening adapted to have a plurality of wire ends insertable therein. A portion of the chuck is moveable between an inoperable position wherein the wire ends can be inserted into the opening and an operative position wherein the chuck tightly grasps the wire ends. An electrical motor carried by the pliers and connected to the chuck is capable of rotating the chuck. An electrical switch is carried by the pliers and is located so as to be pressed by a user's thumb while holding the pliers. When the switch is activated, the electrical motor rotates the chuck to twist the wire ends together.

7 Claims, 2 Drawing Sheets

POWER PLIERS FOR TWISTING WIRES

BACKGROUND OF THE INVENTION

The present invention is directed toward apparatus for twisting wires and, more particularly, toward a pair of pliers that incorporates a power driven chuck for twisting together the ends of a plurality of electrical wires for making an electrical connection between them. The twisted wire ends are then covered by an insulated wire nut.

Electricians, technicians, mechanics, home handymen and numerous others frequently must connect the ends of electrical wires together. Such connections must provide both electrical continuity and be mechanical secure. This is normally accomplished by twisting the ends of the wires together. In many cases, it is desirable to secure three or four or more wire ends together. After the wire ends are twisted together, an insulated wire nut or similar device is threaded thereon to maintain the wire ends in place.

If high gauge wires or numerous smaller gauge wires are to be connected together, a substantial force must be applied to effectuate the twist. Usually pliers or the like are utilized to accomplish the twisting. This is done by grasping the several wire ends with the pliers and turning the pliers. Obviously, the pliers can be turned only ninety degrees or so before the pliers must be released and the wires gripped again to continue the twisting. This can be time consuming and can put undue force on the electrician's arm.

To Applicant's knowledge, there is no tool available to assist in twisting wire ends together. And there certainly is no power tool available for this purpose. Therefore, a need exists for a power operated hand tool that can easily and quickly twist the ends of electrical wires together.

SUMMARY OF THE INVENTION

The present invention is designed to overcome the deficiencies of the prior art discussed above. It is an object of the present invention to provide a tool that can easily twist wire ends together.

It is another object of the present invention to provide a power tool for connecting wire ends together that requires substantially no manual force or effort.

In accordance with the illustrative embodiments, demonstrating features and advantages of the present invention, there is provided a pair of power driven pliers capable of twisting the ends of a plurality of electrical wires together to make an electrical and mechanical connection therebetween. The pliers include first and second jaws and first and second handles. The jaws and handles are pivotally connected to each other at a pivot point such that movement of said handles toward or away from each other moves said jaws toward and away from each other. A rotatable chuck is carried by one of the jaws and has a central opening adapted to have a plurality of wire ends insertable therein. A portion of the chuck is moveable between an inoperable position wherein the wire ends can be inserted into the opening and an operative position wherein the chuck tightly grasps the wire ends. An electrical motor carried by the pliers and connected to the chuck is capable of rotating the chuck. An electrical switch is carried by the pliers and is located so as to be pressed by a user's thumb while holding the pliers. When the switch is activated, the electrical motor rotates the chuck to twist the wire ends together.

Other objects, features, and advantages of the invention will be readily apparent from the following detailed description of the preferred embodiments thereof taken in conjunction with the drawings.

BRIEF DESCRIPTION OF THE DRAWINGS

For the purpose of illustrating the invention, there are shown in the accompanying drawings, one form that is presently preferred; it being understood that the invention is not intended to be limited to the precise arrangements and instrumentalities shown.

DETAILED DESCRIPTION OF THE PREFERRED EMBODIMENTS

Figure 1:
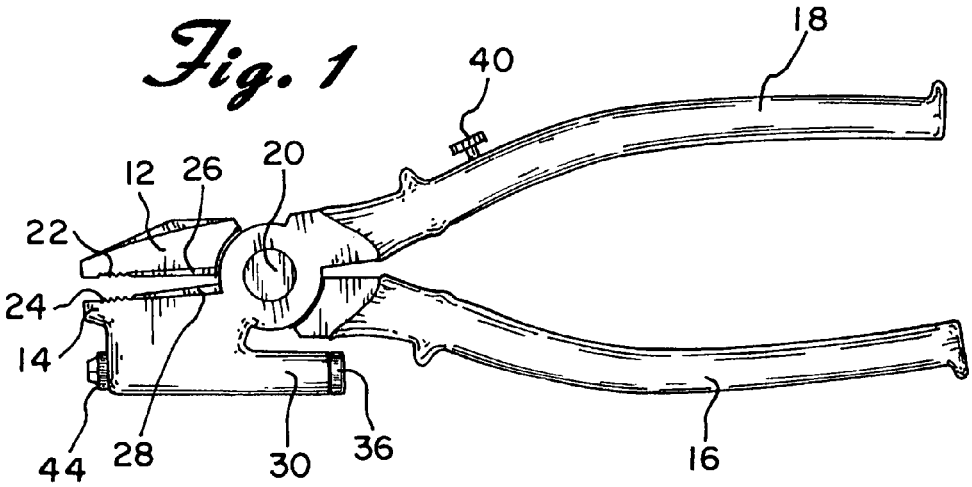
FIG. 1 is a side elevational view of a pair of power driven pliers for twisting the ends of electrical wires of the present invention.
Figure 2:
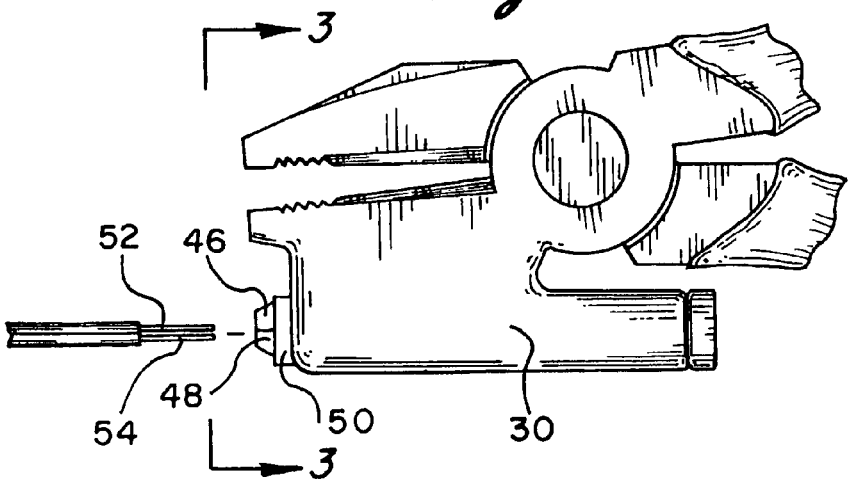
FIG. 2 is a view similar to FIG. 1 of the jaws of the pliers showing wire ends to be twisted approaching the chuck.
Figure 3:
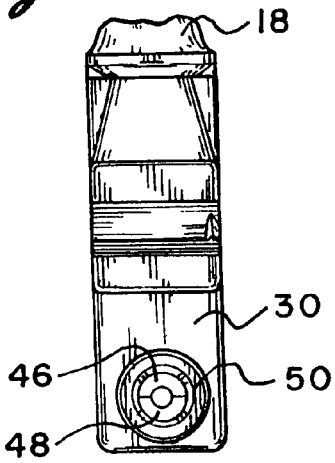
FIG. 3 is a partial front elevational view as viewed from the line 3-3 of FIG. 2.
Figure 4:
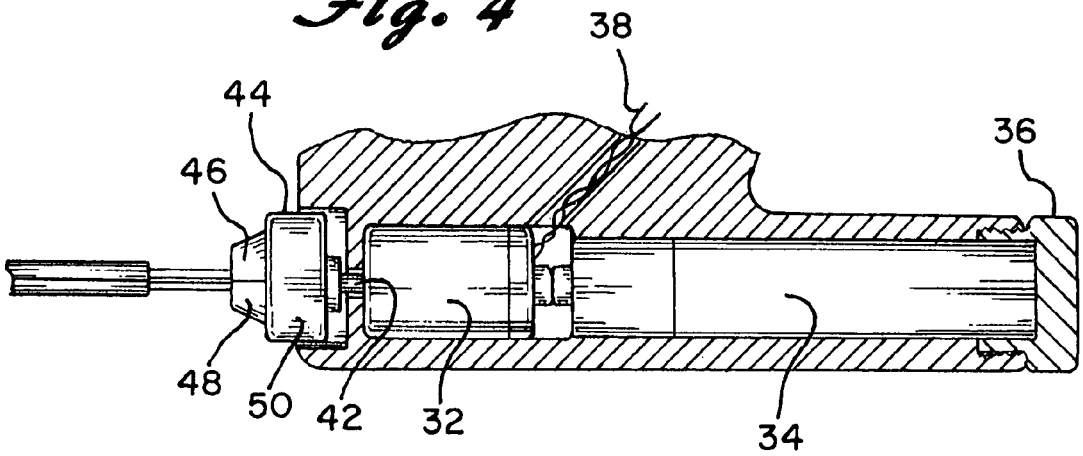
FIG. 4 is a partial sectional view with portions cut away showing the power supply and drive system of the invention.
Figure 5:
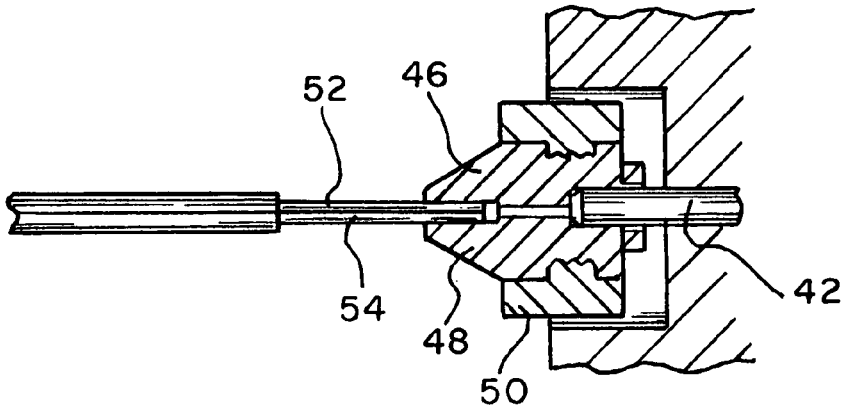
FIG. 5 is a partial sectional view with portions cut away of the forward end of the drive system showing the wire ends held in the chuck.

Referring now to the drawings in detail wherein like reference numerals have been used throughout the various figures to designate like elements, there is shown in FIG. 1 a pair of power driven pliers for twisting the ends of electrical wires constructed in accordance with the principles of the present invention and designated generally as 10. The pliers 10 are, per se, somewhat conventional in that they include a first jaw 12, a second jaw 14, a first handle 16 and a second handle 18. The jaws and handles 12, 14, 16 and 18 are pivotally connected to each other at pivot point 20 such that movement of the handles 16 and 18 toward and away from each other moves the jaws 12 and 14 towards and away from each other. As can be seen from FIG. 1, the handles and jaws essentially define a plane and movement of the handles and jaws is within this plane. Although other materials are possible, the pliers may be made primarily of forged steel.

In addition to gripping surfaces 22 and 24, the jaws 12 and 14 also include cooperating wire cutters 26 and 28. Pliers including cutters such as these are generally referred to as side cutters.

Secured to the lower portion of the second jaw 14 is a housing 30. The housing 30 could be constructed as a separate unit that is connected to the second jaw 14. Alternatively, and as shown in the figures, the housing 30 can be formed as an integral part of the second jaw 14 and handle 18. If formed as an integral part thereof, the housing 30 will be made of the same forged steel as the remaining parts of the pliers. If the housing 30 is constructed separately and attached to the jaw 14, it can be made of any material suitable for the intended purpose and it can be secured to the jaw 14 utilizing any known connecting method, such as by welding or the like.

Contained within the housing 30 is an electric motor 32 having a rotating shaft 42 which lies in the same plane defined by the handles and jaws discussed above. A battery 34 is also contained within the housing 30 and is capable of driving the motor 32. A screw cap 36 at the opposite end of the housing 30 allows the battery 34 to be removed and replaced as needed.

Electrical wiring 38 runs from the motor 32 to the momentary contact switch 40 mounted on the handle 18. The wiring 38 could be internal or external to the handle 18. Depressing the switch 40 causes the motor 32 to rotate.

Secured to the forward end of the rotating shaft 42 of the motor 32 is a rotatable chuck assembly 44. The chuck assembly 44 is shown only diagrammatically since the details thereof are not believed to be necessary as they are, per se, well known. The chuck assembly 44 can be essentially any known keyless chuck such as those used with battery-operated screwdrivers or power drills or the like. Examples can be found in U.S. Pat. Nos. 5,186,478; 6,139,228; 6,488,287 and 6,637,756. These are, of course, by way of example only and other known chuck assemblies could also be utilized.

In any event, the rotatable chuck assembly 44 is of the type that includes two movable grippers 46 and 48. The movable grippers 46 and 48 are movable toward and away from each other by rotating the rotatable collar 50. Again, the manner in which the chuck operates is well known. When the collar 50 is rotated in one direction, the gripping members 46 and 48 move into an inoperative position where they are spaced from each other thereby creating a central opening in the chuck assembly into which a plurality of wire ends 52 and 54 can be inserted. Once the wire ends 52 and 54 are inserted into the opening, the collar 50 is rotated so that gripping members 46 and 48 move into an operative position where they grip the wire ends 52 and 54. Thereafter, the switch 40 is depressed so that the motor 32 rotates the chuck 44 thereby twisting the wire ends into the form shown in FIG. 6.

While only two wire ends 52 and 54 are shown being twisted together, this is by way of example only. It should be readily apparent that the pliers 10 of the present invention are quite capable of twisting three or more wire ends together. Furthermore, various gauges of wires can be acted upon. If desired, more than one pair of pliers 10 could be provided with one pair being smaller than the other for twisting smaller gauge wire ends together and the other pair being larger for twisting together substantially larger gauge wires.

Figure 6:
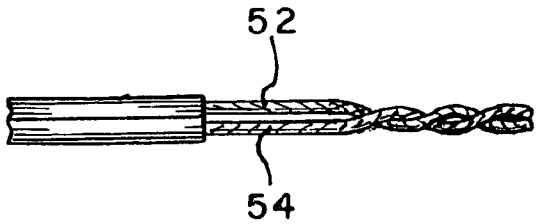
FIG. 6 is a view of the wire ends after they have been twisted by the pliers of the invention.

After the wires are twisted as shown in FIG. 6, it is often desirable to cover the twisted wire ends with a wire nut, not shown. The pliers 10 of the present invention could be used for applying a wire nut. In this regard, a wire nut applicator such as shown in U.S. Pat. No. 5,784,935 or 6,922,887 can be inserted into the chuck 44 in order to apply a wire nut.

The present invention may be embodied in other specific forms without departing from the spirit or essential attributes thereof and accordingly, reference should be made to the appended claims rather than to the foregoing specification as indicating the scope of the invention.

I claim:

1. Power driven pliers for twisting the ends of a plurality of electrical wires together to make an electrical connection between said plurality of wires comprising:

first and second jaws and first and second handles, said jaws and handles being pivotally connected to each other at a pivot point such that movement of said handles toward each other moves said jaws toward each other;

a rotatable chuck carried by one of said first and second jaws, said chuck having a central opening adapted to have a plurality of wire ends insertable therein, a portion of said chuck being moveable between an inoperable position wherein said wire ends can be inserted into said opening and an operative position wherein said chuck tightly grasps said wire ends;

an electrical motor carried by said pliers and connected to said chuck so as to be capable of rotating said chuck;

electrical switch means carried by said pliers;

whereby, when said switch is activated, said electrical motor rotates said chuck to twist said wire ends together.

2. The power driven pliers for twisting the ends of a plurality of electrical wires together as claimed in claim 1 further including a housing carried by said one of said first and second jaws and wherein said electrical motor is contained within said housing.

3. The power driven pliers for twisting the ends of a plurality of electrical wires together as claimed in claim 2 further including a battery contained within said housing, said battery being capable of driving said electrical motor.

4. The power driven pliers for twisting the ends of a plurality of electrical wires together as claimed in claim 1 wherein said chuck is secured to one of said first and second jaws and moves therewith even in the absence of anything being held within said central opening of said chuck.

5. The power driven pliers for twisting the ends of a plurality of electrical wires together as claimed in claim 1 wherein said electric motor includes a drive shaft and wherein said drive shaft is located within one of said first and second jaws.

6. The power driven pliers for twisting the ends of a plurality of electrical wires together as claimed in claim 1 wherein said first and second jaws and first and second handles of said pliers define a plane whereby movement of said handles and said jaws is within said plane and wherein said chuck is rotated about an axis that lies within said plane.

7. The power driven pliers for twisting the ends of a plurality of electrical wires together as claimed in claim 1 wherein said jaws include cooperating wire cutters.

* * * * *